United States Patent [19]

Sterbik

[11] Patent Number: 4,524,973

[45] Date of Patent: Jun. 25, 1985

[54] GRIP-CORRECTING GOLF CLUB HANDLE

[76] Inventor: William G. Sterbik, 11101 Continental Ave., Cleveland, Ohio 44104

[21] Appl. No.: 627,010

[22] Filed: Jul. 2, 1984

[51] Int. Cl.[3] ..... A63B 69/36

[52] U.S. Cl. ..... 273/183 D; 273/81.4; 273/81 B; 273/186 C

[58] Field of Search ..... 273/183 D, 186 A, 186 C, 273/81 R, 81 B, 81 A, 81 C, 81 D, 162 R

[56] References Cited

U.S. PATENT DOCUMENTS 3,111,322 11/1963 English ..... 273/183
3,408,075 10/1968 Colton ..... 273/81.4 X
3,687,458 8/1972 Proctor ..... 273/183
3,834,714 9/1974 Smolinski ..... 273/81 R X

*Primary Examiner*—George J. Marlo
*Attorney, Agent, or Firm*—Norman B. Rainer

[57] ABSTRACT

A golf club handle which compensates for gripping pressure differences between upper and lower hands is comprised of a tubular housing which accommodates upper and lower depressor pads positioned in opposite sides of the housing. Springs associated with each depressor pad and positioned within the housing force the depressor pads outwardly. The force of the upper spring is greater than the force of the lower spring. Levers within the housing couple the relative movements of the depressor pads so that inward movement of one pad produces outward movement of the other pad.

3 Claims, 6 Drawing Figures

GRIP-CORRECTING GOLF CLUB HANDLE

BACKGROUND OF THE INVENTION

This invention relates to improvements in handles for golf clubs, and more particularly concerns a golf club handle provided with a device for adjusting the relative gripping forces applied by the right and left hands holding the handle.

With the grip normally used by a right-handed golfer, the left hand grips the handle of the club at the uppermost end thereof while the right hand grips the handle immediately below the left hand and, in some instances, the right hand partially overlaps the left hand. For a proper swing which will minimize slicing and hooking, it is considered essential that the gripping pressure of the upper hand be greater than the gripping pressure of the lower hand.

Although practice and training devices and techniques have been disclosed for helping the golfer to correct his grip, functional improvements in golf club handles for alleviating the consequences of an improper grip have not heretofore been available.

It is accordingly an object of the present invention to provide a golf club handle which automatically compensates for gripping pressure differences between upper and lower hands.

It is a further object of this invention to provide a golf club handle as in the foregoing object which causes the effective lower hand gripping pressure to be lower than the effective upper hand gripping pressure in the course of a corrected swing of a golf club incorporating said handle.

It is another object of the present invention to provide a golf club having a handle of the aforesaid nature.

It is a still further object of this invention to provide a handle of the aforesaid nature of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by a golf club handle which comprises:

(a) a tubular housing having a curved sidewall, an upper extremity adapted to be closed, a lower extremity, and upper and lower apertures elongated in the direction of the axis of said housing and positioned in opposite sides of said sidewall, (b) upper and lower depressor pads adapted to slideably engage said upper and lower apertures respectively, each pad having a finger-contacting surface extremity extending exteriorly of said housing and an opposed inwardly directed extremity disposed within the interior of said housing, the length of said finger-contacting surfaces being adequate to contact the last three fingers of each hand of a golfer, (c) retainer means associated with the inwardly directed extremity of each pad adapted to prevent disengagement of said pads from said apertures, (d) upper and lower spring means located within said housing in association with each pad and adapted to urge each respective pad outwardly from said housing, the force of said upper spring means being greater than the force of said lower spring means, and (e) upper and lower levers located within said housing, each having upper and lower extremities, the upper extremity of said upper lever being movably associated with said upper pad, the lower extremity of said lower lever being movably associated with said lower pad, the lower extremity of said upper lever and upper extremity of said lower lever being pivotably and movably interengaged, whereby (f) inward movement of the upper pad against the urging of its spring means causes outward movement of said lower pad, and conversely, inward movement of said lower pad against the urging of its spring causes outward movement of said upper pad.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
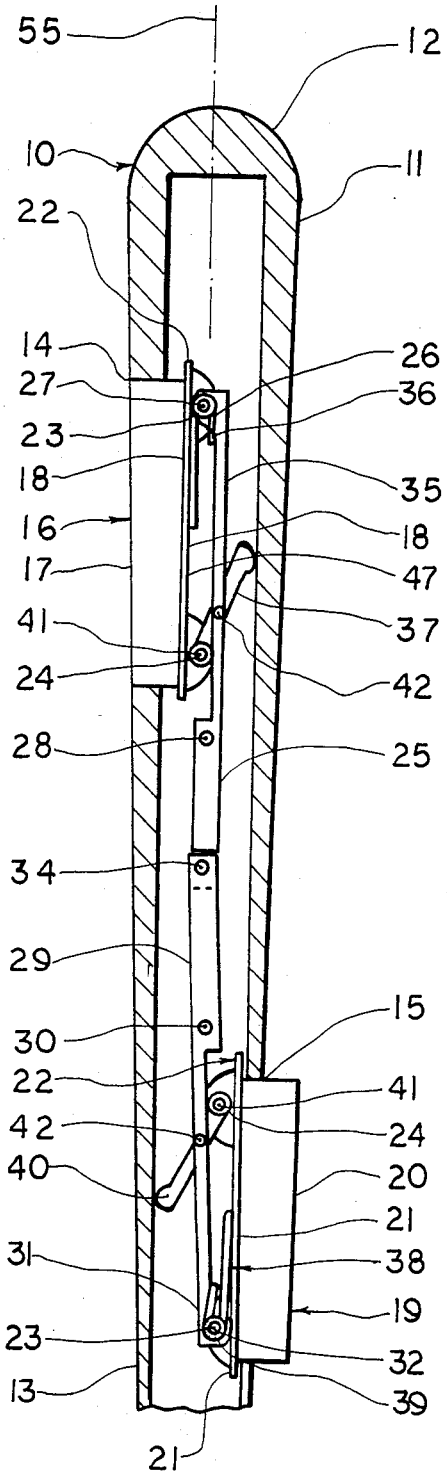
FIG. 1 is a sectional side view of an embodiment of the golf club handle of this invention.

For convenience in description, the terms "upper" and "lower", or words of similar import, will have reference to the upper and lower extremities, respectively, of the handle appearing in FIG. 1. Similarly, the expressions "inward" and "outward" or terms equivalent thereto refer to the interior and exterior, respectively, of the tubular housing of FIGS. 1 and 2.

DESCRIPTION OF THE PREFERRED EMBODIMENT

Figure 2:
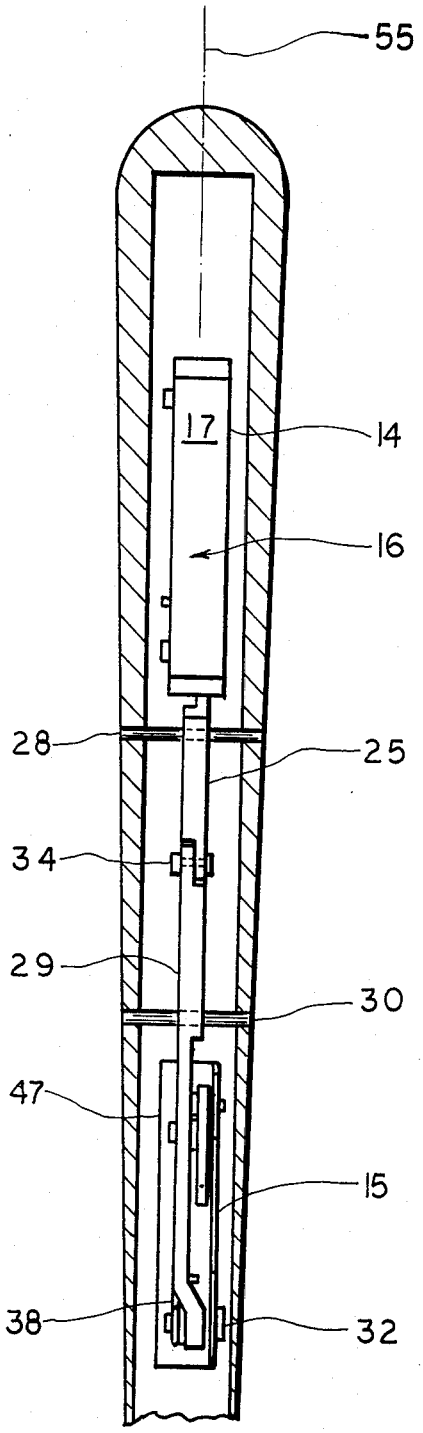
FIG. 2 is a view taken from the left side of the illustration of FIG. 1, with portions broken away to reveal internal details.

Referring to FIGS. 1 and 2, a golf club handle of this invention is shown comprised of tubular housing 10 having curved sidewall 11 symmetrically disposed about center axis 55, closed upper extremity 12, and lower extremity 13 which may have means for securely engaging the shank of a golf club. Upper and lower apertures 14 and 15, respectively, are formed within curved sidewall 11, said apertures being of generally rectangular configuration elongated in the direction of the axis of the housing, and positioned on opposite sides thereof.

Upper depressor pad 16, having a shape and size generally complementary to the shape and size of upper aperture 14, is slideably positioned within said aperture. The pad is comprised of finger-contacting exterior surface 17 outwardly disposed from said housing, and opposed inwardly directed flat surface extremity 18 disposed within the interior of the housing. Similarly, lower depressor pad 19, having a shape and size generally complementary to the shape and size of lower aperture 15, is slideably positioned within said aperture. Pad 19 is comprised of finger-contacting exterior surface 20 outwardly disposed from said housing, and opposed inwardly directed flat surface extremity 21 disposed within the interior of the housing. The lengths of said finger-contacting exterior surfaces will range from about 2 to 3 inches, which is adequate to contact the last three fingers of each hand of the golfer.

Figure 3:
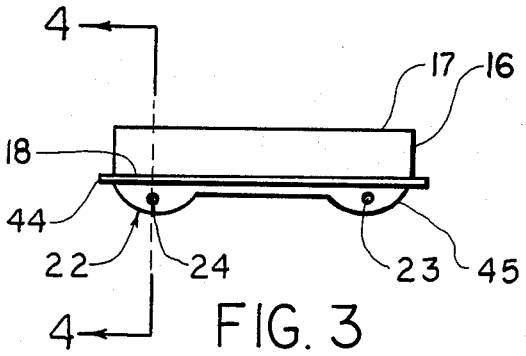
FIG. 3 is a side view of a depressor pad and associated retainer plate utilized in the embodiment of FIG. 1.
Figure 4:
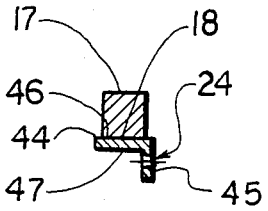
FIG. 4 is a sectional view taken on the line 4—4 of FIG. 3.

A retainer plate 22 is affixed to the inwardly directed extremity of each pad, one purpose of said retainer plate being to prevent the pads from passing completely outwardly through curved sidewall 11. As shown more clearly in FIGS. 3 and 4, the exemplified embodiment of retainer plate 22 has the form of a right angled L-shaped bracket comprised of shelf panel 44, and mounting panel 45. The inwardly directed extremities of the depressor pads are attached to the outwardly directed surface 46 of shelf panel 44. First and second channels 23 and 24, respectively, are incorporated within mounting panel 45, said channels extending in directions perpendicular to the axis of said housing and serving to retain bearing pins, as will hereinafter be shown.

An upper lever 25 is held by upper stationary pivot pin 28 which extends transversely across said housing in fixed engagement with curved sidewall 11 and penetrates circular aperture 52 of said lever. Upper extremity 26 of upper lever 25 rotatively engages bearing pin 27 retained by first channel 23 of mounting panel 45 of upper retainer plate 22. Similarly, lower lever 29 is held by lower stationary pivot pin 30 in fixed engagement with said housing and parallel to upper stationary pivot pin 28. Lower extremity 31 of said lower lever rotatively engages bearing pin 32 retained by first channel 23 of mounting panel 45 of lower retainer plate 22. The upper extremity of the lower lever and the lower extremity of the upper lever and movably interconnected by rivet 34 which penetrates aligned apertures 53 in said levers.

Figure 5:
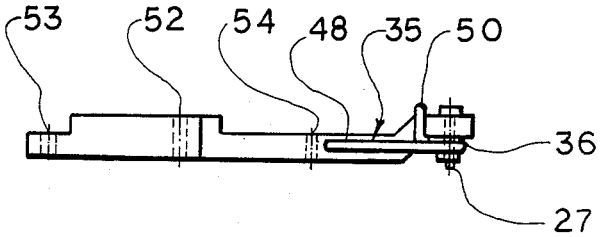
FIG. 5 is a top view of a lever and associated spring utilized in the embodiment of FIG. 1.
Figure 6:
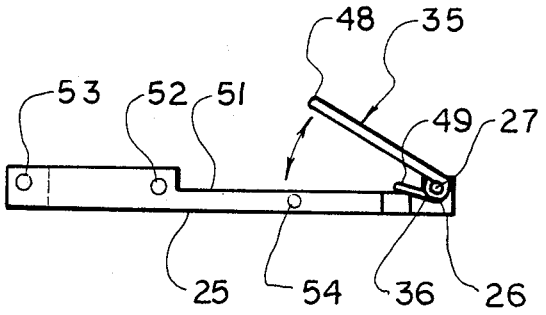
FIG. 6 is a side view of the lever and spring of FIG. 5.

An upper bent spring 35 is provided with loop 36 at its upper extremity which engages bearing pin 27. A long lower leg portion 48 of spring 35 is outwardly angled and adapted to lie in abutment with inwardly directed surface 47 of shelf panel 44 of retainer plate 22. As shown more clearly in FIGS. 5 and 6, short lower leg portion 49 of said spring is provided with a terminal arm 50 adapted to bear against the outwardly directed edge 51 of lever 25. In such manner of structure and deployment, spring 35 exerts a force which tends to separate a lever and its associated depressor pad.

In a manner functionally similar to the effect produced by upper spring 35, lower bent spring 38 is provided with loop 39 at its lower extremity which engages bearing pin 32. A long leg portion of spring 38 is outwardly angled and adapted to lie in abutment with the inwardly directed surface of the shelf panel of the lower retainer plate. A short leg portion of the spring has a terminal arm that bears against the outwardly directed edge of the lower lever. The lower spring is, however, adapted to exert less separating force than the upper spring with respect to its associated lever and depressor pad.

A leveling arm 37 is associated with each of the two levers. One extremity of each leveling arm is held in fixed position by rotative engagement with pivot pin 41 retained by second channel 24 of each retainer plate. The opposite extremity of each leveling arm is adapted to abut against the inside wall of the housing. At an intermediate site along the length of each leveling arm, pivoted attachment is made with an associated lever by means of rivet 42 which penetrates aperture 54 of said lever. The function of the leveling arms or means of equivalent function is to cause the force of the associated spring to be evenly applied against the inwardly directed extremities of the pads.

The golf club handle of this invention may be adapted to be attached to existing golf club shafts, or may be integrally incorporated into a golf club. The handle may be used for regular play or may be used merely for practice purposes. Although the tubular housing of the exemplified embodiment is shown in circular cylindrical configuration, other configurations may be employed. The depressor pads may be fabricated of rigid or moderately resilient material.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A golf club handle comprising:

(a) a tubular housing having a curved sidewall, an upper extremity adapted to be closed, a lower extremity, and upper and lower apertures elongated in the direction of the axis of said housing and positioned in opposite sides of said sidewall, (b) upper and lower depressor pads adapted to slideably engage said upper and lower apertures respectively, each pad having a finger-contacting surface extremity extending exteriorly of said housing and an opposed inwardly directed extremity disposed within the interior of said housing, the length of said finger-contacting surfaces being adequate to contact the last three fingers of each hand of a golfer, (c) retainer means associated with the inwardly directed extremity of each pad adapted to prevent disengagement of said pads from said apertures, (d) upper and lower spring means located within said housing in association with each pad and adapted to urge each respective pad outwardly from said housing, the force of said upper spring means being greater than the force of said lower spring means, and (e) upper and lower levers located within said housing, each having upper and lower extremities, the upper extremity of said upper lever being movably associated with said upper pad, the lower extremity of said lower lever being movably associated with said lower pad, the lower extremity of said upper lever and upper extremity of said lower lever being pivotably and movably interengaged, whereby (f) inward movement of the upper pad against the urging of its spring means causes outward movement of said lower pad, and conversely, inward movement of said lower pad against the urging of its spring causes outward movement of said upper pad.

2. The golf club handle of claim 1 wherein said tubular housing is of circular cylindrical configuration.

3. The golf club handle of claim 1 further provided with means for causing the force of a spring to be evenly applied against the inwardly directed extremity of an associated depressor pad.

* * * * *